US008789894B2

(12) United States Patent
Lucek et al.

(10) Patent No.: US 8,789,894 B2
(45) Date of Patent: Jul. 29, 2014

(54) RADIAL TOOL WITH SUPERHARD CUTTING SURFACE

(75) Inventors: John W. Lucek, Powell, OH (US); Adrienne Olwert, Westerville, OH (US); Kenneth Monyak, Abingdon, VA (US); Bjorn Claesson, Ronninge (SE)

(73) Assignees: Diamond Innovations, Inc., Worthington, OH (US); Sandvik Intellectual Property AB, Sandviken (SE)

( * ) Notice: Subject to any disclaimer, the term of this patent is extended or adjusted under 35 U.S.C. 154(b) by 721 days.

(21) Appl. No.: 12/648,619

(22) Filed: Dec. 29, 2009

(65) Prior Publication Data

US 2010/0194176 A1 Aug. 5, 2010

Related U.S. Application Data

(60) Provisional application No. 61/144,181, filed on Jan. 13, 2009.

(51) Int. Cl.

| | |
|---|---|
| ***E21C 35/183*** | (2006.01) |
| ***E21C 35/193*** | (2006.01) |
| *E21C 35/18* | (2006.01) |

(52) U.S. Cl.

CPC ..... *E21C 35/183* (2013.01); *E21C 35/1936* (2013.01); *E21C 2035/1809* (2013.01)

USPC ..... 299/108; 299/112 R

(58) Field of Classification Search

USPC ..... 299/79.1, 101, 100, 108, 109, 105, 111, 299/112, 113, 112 R, 112 T; 175/426, 428, 175/430, 420.1, 420.2, 434, 435

See application file for complete search history.

(56) References Cited

U.S. PATENT DOCUMENTS

| | | | |
|---|---|---|---|
| 3,141,746 | A | 7/1964 | De Lai |
| 3,609,818 | A | 10/1971 | Wentorf, Jr. |

(Continued)

FOREIGN PATENT DOCUMENTS

| | | | |
|---|---|---|---|
| CN | 1443267 | A | 9/2003 |
| CN | 2570458 | Y | 9/2003 |

(Continued)

OTHER PUBLICATIONS

Patent Examination Report No. 1 for Australian Application No. 2009337061, dated Feb. 4, 2013.

(Continued)

*Primary Examiner* — Sunil Singh

(74) *Attorney, Agent, or Firm* — Morgan, Lewis & Bockius LLP

(57) ABSTRACT

A non-rotating mining cutter pick has a shank portion with a non-circular cross-section, a head portion including a tip region distal from the shank portion, a shoulder portion separating the shank portion from the head portion, and a cutting insert mounted at a front end of the tip region. The cutting insert includes a body formed of tungsten carbide and an element formed of a superhard material, such as PCD or other material having a prescribed knoop hardness. At least a portion of a first surface of the element is exposed on a cutting surface of the cutting insert, which improves wear properties of the mining cutter pick. The element is fused to the body of the cutting insert, preferably in a high pressure-high temperature (HPHT) process. A method of manufacture and a cutting machine incorporating the non-rotating mining cutter pick on the rotatable element are also disclosed.

17 Claims, 11 Drawing Sheets

(56) References Cited

U.S. PATENT DOCUMENTS

| | | | | | |
|---|---|---|---|---|---|
| 3,745,623 | A | | 7/1973 | Wentorf, Jr. et al. | |
| 3,850,591 | A | | 11/1974 | Wentorf, Jr. | |
| 4,124,401 | A | | 11/1978 | Lee et al. | |
| 4,194,790 | A | | 3/1980 | Kenny et al. | |
| 4,255,165 | A | * | 3/1981 | Dennis et al. | 51/309 |
| 4,268,276 | A | * | 5/1981 | Bovenkerk | 51/295 |
| 4,277,106 | A | | 7/1981 | Sahley | |
| 4,394,170 | A | | 7/1983 | Sawaoka et al. | |
| 4,403,015 | A | | 9/1983 | Nakai et al. | |
| 4,674,802 | A | | 6/1987 | McKenna et al. | |
| 4,797,326 | A | | 1/1989 | Csillag | |
| 4,913,125 | A | | 4/1990 | Bunting et al. | |
| 4,944,559 | A | | 7/1990 | Sionnet et al. | |
| 4,954,139 | A | | 9/1990 | Cerutti | |
| 5,092,310 | A | * | 3/1992 | Walen et al. | 125/43 |
| 5,217,081 | A | * | 6/1993 | Waldenstrom et al. | 175/420.2 |
| 5,248,006 | A | * | 9/1993 | Scott et al. | 175/420.2 |
| 5,435,403 | A | | 7/1995 | Tibbitts | |
| 5,592,995 | A | * | 1/1997 | Scott et al. | 175/374 |
| 5,806,934 | A | | 9/1998 | Massa et al. | |
| 6,135,219 | A | | 10/2000 | Scott | |
| 6,733,087 | B2 | | 5/2004 | Hall et al. | |
| 6,868,848 | B2 | | 3/2005 | Boland et al. | |
| 7,124,795 | B2 | * | 10/2006 | Kammerer | 144/241 |
| 7,393,061 | B2 | | 7/2008 | Hesse et al. | |
| 8,066,087 | B2 | * | 11/2011 | Griffo et al. | 175/432 |
| 2006/0144621 | A1 | * | 7/2006 | Tank et al. | 175/61 |
| 2008/0035383 | A1 | * | 2/2008 | Hall et al. | 175/414 |
| 2008/0053711 | A1 | | 3/2008 | O'Neill | |
| 2009/0256413 | A1 | * | 10/2009 | Majagi et al. | 299/100 |

FOREIGN PATENT DOCUMENTS

| | | | |
|---|---|---|---|
| DE | 295 03 743 | | 7/1995 |
| FR | 2 605 676 | A1 | 4/1988 |
| GB | 884224 | | 12/1961 |
| GB | 1000701 | | 8/1965 |
| GB | 1006617 | | 10/1965 |
| GB | 1212200 | | 11/1970 |
| GB | 2 193 740 | A | 2/1988 |
| GB | 2 452 603 | | 3/2009 |
| RU | 2071562 | | 1/1997 |
| RU | 2 320 615 | C9 | 3/2008 |
| SU | 448288 | | 10/1974 |
| WO | WO 02/24601 | | 3/2002 |
| WO | 2009/053903 | | 4/2009 |

OTHER PUBLICATIONS

Notification of the First Office Action for Chinese Application No. 200980154566.7, dated Apr. 16, 2013.

J.R. David, Ed., *Metals Handbook, Desk Edition, 2nd Ed.*, ASM International, Materials Park, OH (1998), p. 31.

J.R. Davis, "*Hardfacing, Weld Cladding, and Dissimilar Metal Joining," ASM Handbook Volume 6: Welding, Brazing, and Soldering*, D. L. Olson, et al., Eds., ASM International, Materials Park, OH (1993), pp. 789-822.

"*Your perfect partner: Cemented Carbide*," Sandvik Hard Materials (2008), retrieved from the internet at www.allaboutcementedcarbide.com.,1 page.

"*Hardness*," NDT Resource Center, retrieved from the internet on Aug. 27, 2013 at http://www.ndt-ed.org/EducationResources/CommunityCollege/Materials/Mechanical/Hardness.htm, 3 pages.

Second Office Action (with English translation) for Chinese Application No. 200980154566.7, dated Jan. 3, 2014.

Official Action (with English translation) for Russian Application No. 2011134051/03(050450), dated Dec. 13, 2013.

Patent Examination Report No. 2 for Australian Application No. 2009337061, dated Jun. 24, 2013.

Decision on Grant (with English translation) for Russian Application No. 2011-134051/03(050450), dated Feb. 4, 2014.

* cited by examiner

RADIAL TOOL WITH SUPERHARD CUTTING SURFACE

RELATED APPLICATION DATA

This application claims priority under 35 U.S.C. §119(e) to U.S. Provisional Application No. 61/144,181, filed Jan. 13, 2009, the entire contents of which are incorporated herein by reference.

FIELD

The present disclosure relates to a material removal tool. More particularly, the present disclosure relates to a non-rotating, radial mining cutter pick having superhard material, such as polycrystalline diamond (PCD), embedded in a cutting insert so that at least a region of the cutting surface includes exposed superhard material. The disclosure also relates to a method of manufacture and to a cutting machine with a rotating element on which the mining cutter pick is mounted and to a method of mining.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

Mining tools, such as for soft rock mining and long wall mining, have a shank for insertion into a toolholder. A forward oriented working portion engages with the mineral formation during operation, e.g., is driven into and along a face of a formation such as a coal formation. Typically, an insert is positioned on the forward working portion to cut into the mineral formation. Inserts of hard wear resistant material are used to enhance the life of the insert as it removes the mineral formation.

In long wall mining, a plurality of mining cutting picks are usually mounted on a rotatable drum with the insert positioned to face the direction of rotation and to have a cutting edge on the insert impacting the mineral formation. A clearance face is provided behind the insert to reduce the rubbing of the forward working portion against the mineral formation as the bit passes therethrough and to provide a relief or evacuating path for cuttings.

Under use conditions, wear develops across the forward working portion of the cutting pick, both on face of the insert and on the forward portions of the cutting pick itself. Increased rubbing and abrasion of these surfaces against the mineral formation causes wear and can generate excessive heat that can lead to insert failure. Also, as a wear scar develops across the clearance face of the insert and the contact surface tends to planarize, increasing machine power consumption rises and dust creation increases.

Examples of mining tools are disclosed in U.S. Pat. Nos. 4,194,790; 4,277,106; 4,674,802; 4,913,125; 5,806,934; and 7,393,061; GB 884,224; GB 1,000,701; GB 1,006,617; GB 1,212,200; and DE 295 03 743

SUMMARY

An exemplary embodiment of a non-rotating mining cutter pick comprises a shank portion with a non-circular cross-section, a head portion including a tip region distal from the shank portion, a shoulder portion separating the shank portion from the head portion, and a cutting insert mounted at a front end of the tip region, wherein the cutting insert includes a body formed of tungsten carbide and an element formed of a superhard material, wherein the element formed of the superhard material is fused to the body, and wherein at least a portion of a first surface of the element formed of the superhard material is exposed on a cutting surface of the cutting insert.

An exemplary embodiment of a method of manufacturing a cutting insert for a radial tool pick comprises forming a void space in a sintered body formed of a composition including tungsten carbide, placing a composition including powdered superhard material in the void space, fusing the composition including powdered superhard material to the sintered body by a high pressure-high temperature process to form the cutting insert, and optionally grinding the cutting surface to taper an edge of a cutting surface.

An exemplary embodiment of a method of manufacturing a cutting insert for a radial tool pick comprises forming a void space in a green body formed of a composition including tungsten carbide, placing a composition including powdered superhard material in the void space, sintering the green body while simultaneously fusing the composition including powdered superhard material to the sintered body by a high pressure-high temperature process to form the cutting insert, and optionally grinding the cutting surface to taper an edge of a cutting surface.

It is to be understood that both the foregoing general description and the following detailed description are exemplary and explanatory and are intended to provide further explanation of the invention as claimed.

BRIEF DESCRIPTION OF THE DRAWING

The following detailed description can be read in connection with the accompanying drawings in which like numerals designate like elements and in which.

DETAILED DESCRIPTION

Figure 1A:
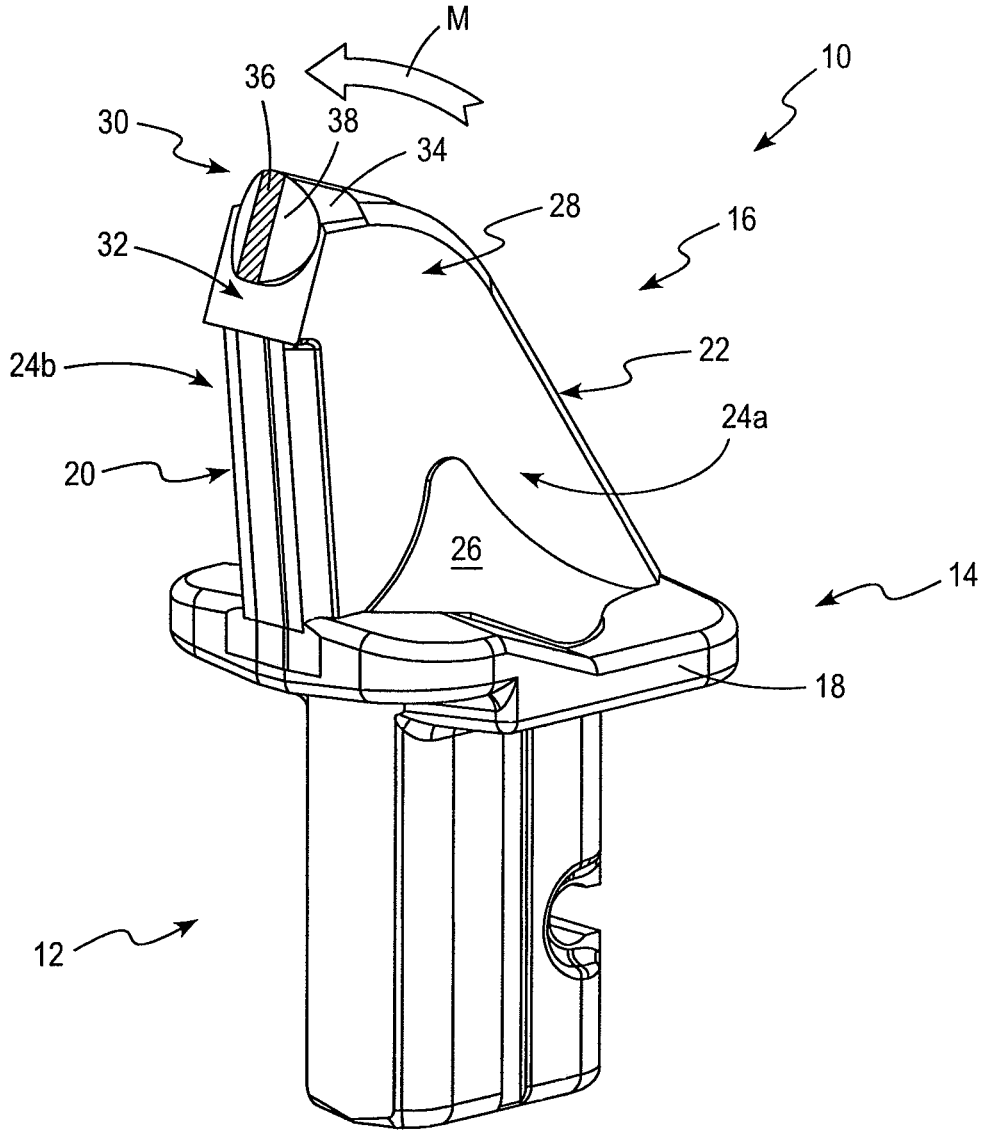
FIG. 1A is a schematic view of an exemplary embodiment of a mining cutter pick.

FIG. 1A is a schematic view of an exemplary embodiment of a mining cutter pick. The mining cutter pick 10 in the FIG. 1A view comprises a shank portion 12, a shoulder portion 14, and a head portion 16.

The shank portion 12 has a non-circular cross-section. The several shank surfaces shown in the FIG. 1A embodiment can be arranged generally orthogonally or can be angled as described in U.S. Pat. No. 4,913,125, the entire contents of which are incorporated herein by reference. Further, the intersection of any two surfaces can be curved with a radius or can be sharp. In general, the shape of the shank portion contributes to the non-rotating character of the mining cutter pick when mounted in a correspondingly-shaped socket in a pick box.

The shoulder portion 14 separates the shank portion 12 from the head portion 16 with a radially extending flange or skirt 18.

The head portion 16 includes a front surface 20, a rear surface 22 and flank surfaces 24*a*, 24*b* interconnecting the front surface 20 and the rear surface 22. In relation to the direction of motion M in use, the front surface 20 is a leading edge and the rear surface 22 is a trailing edge. The flank surfaces 24*a*, 24*b* can each include a buttress portion 26, which ties the head portion 16 into the shoulder portion 14 to provide support to the head portion 16. In alternative embodiments, the cutting insert is substantially wholly formed from a superhard material.

The head portion 16 includes a tip region 28 distal from the shank portion 12. A cutting insert 30 is mounted at a front end 32 of the tip region 28. The cutting insert 30 includes a body 34 and an element 36 formed of a superhard material. The element 36 formed of the superhard material is fused to the body 34. The body 34 is formed of a material with a hardness value intermediate to the hardness value of the superhard material and the hardness value of the material from which the head portion 16 is formed. In an exemplary embodiment, the body 34 is formed of tungsten carbide. At least a portion of a first surface of the element 36 formed of the superhard material is exposed on a cutting surface 38 of the cutting insert 30.

Figure 1B:
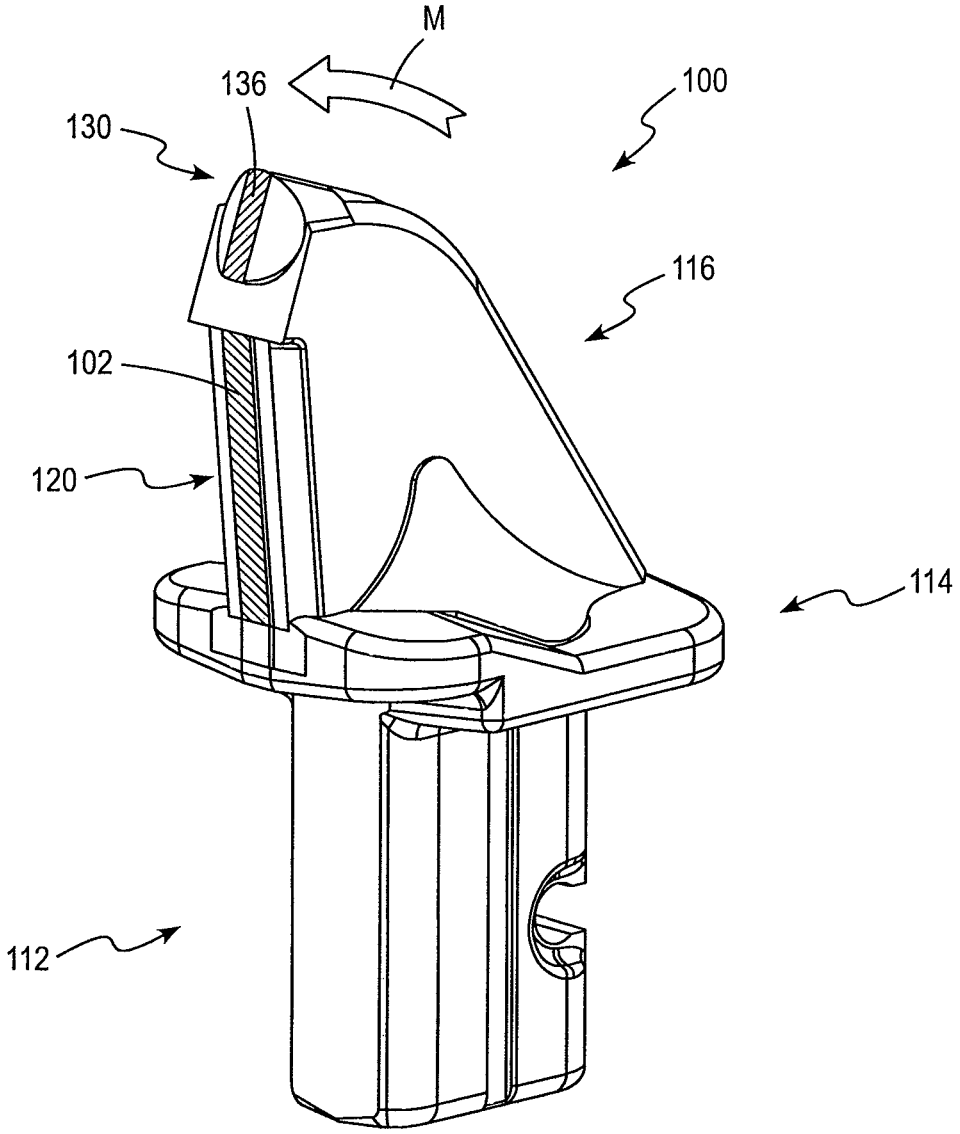
FIG. 1B is a schematic view of another exemplary embodiment of a mining cutter pick.

FIG. 1B is a schematic view of another exemplary embodiment of a mining cutter pick. The mining cutter pick 100 in the FIG. 1B view comprises a shank portion 112, a shoulder portion 114, and a head portion 116 similar to that shown and described in connection with FIG. 1A. In addition to the features of the mining cutter pick 10 shown and described in connection with FIG. 1A, the mining cutter pick 100 in FIG. 1B includes a portion 102 of the front surface 120 of the head portion 116 that is formed of a superhard material. When present, the portion 102 can be discontinuous from the element 136 formed of the superhard material that is exposed on the cutting surface of the cutting insert 130 or can be continuous therewith. In both cases, the portion 102 provides improved wear resistance for the front surface 120 of head portion 116 as the mining cutter pick 100 cuts into a mineral formation when in use.

The form of the cutting insert in any of the embodiments of the mining cutter pick 10, 100 can take any one of various embodiments. Example variations of the cutting insert 30 and the element 36 formed of superhard material are shown and described herein in connection with FIGS. 2-11.

In an exemplary embodiment, the element 36 formed of the superhard material includes a first surface and an opposing second surface, wherein the second surface extends to an interior surface of the body. An example of this arrangement is depicted in FIGS. 2A and 2B.

Figure 2A:
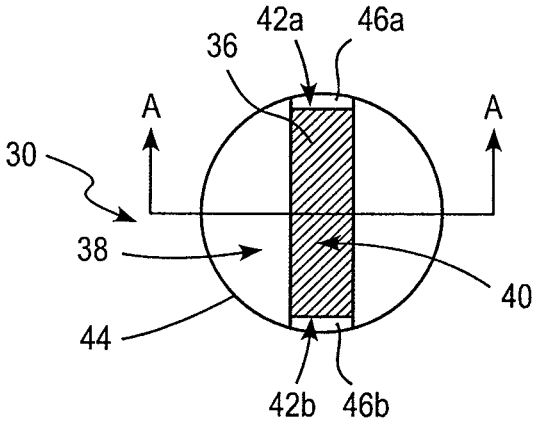
FIGS. 2A and 2B illustrate an exemplary embodiment of a cutting insert with a region formed of a superhard material in plan view (FIG. 2A) and cross-sectional view (FIG. 2B).
Figure 2B:
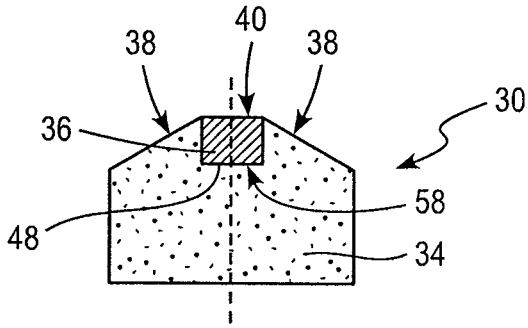

FIGS. 2A and 2B illustrate an exemplary embodiment of a cutting surface with a region formed of a superhard material in plan view (FIG. 2A) and cross-sectional view (FIG. 2B). The plan view in FIG. 2A illustrates the cutting surface 38 of the cutting insert 30. The cross-sectional view in FIG. 2B corresponds to Section A-A in FIG. 2A.

In exemplary embodiments of the cutting insert 30, the element 36 formed of superhard material has a first surface 40 exposed on the cutting surface 38. In the FIGS. 2A and 2B embodiment, the ends 42*a*, 42*b* of the element 36 formed of superhard material do not extend to the periphery 44 of the cutting surface 38. Rather, there is a region of the body 34 of the cutting insert 30 at each end of the element 36 that forms a sidewall 46*a*, 46*b* to the volume occupied by the element 36 formed of superhard material. In an alternative embodiment, one or both of the ends 42*a*, 42*b* of the element 36 formed of superhard material can extend to the periphery 44 of the cutting surface 38 (see, e.g., FIGS. 4A and 5A).

The cross-sectional view in FIG. 2B shows the depth from the cutting surface 38 to which the element 36 formed of superhard material extends. In FIG. 2B, the second surface 48 of the element 36 formed of superhard material terminates in the interior of the body 34. Thus, the second surface 48 extends to an interior surface 50 of the body 34. The second surface 48 is generally opposing the first surface 40. A similar arrangement can apply to one or more of a plurality of elements 36, as shown in the exemplary embodiment of FIG. 7D.

In an alternative embodiment, the element formed of the superhard material includes a first surface and an opposing second surface, and the element formed of the superhard material extends to a base surface of the cutting insert, the base surface opposing the working surface, with the second surface exposed on the base surface. An example of this arrangement is depicted in FIGS. 3A and 3B.

Figure 3A:
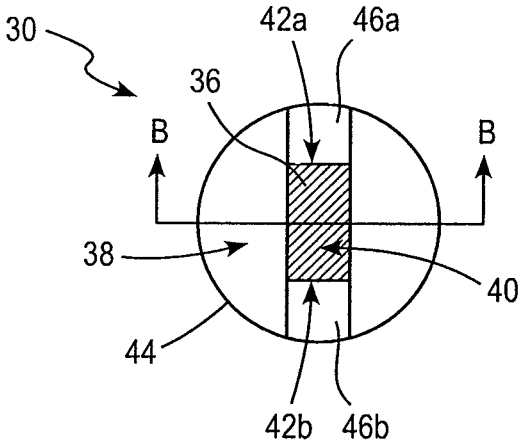
FIGS. 3A and 3B illustrate an exemplary embodiment of a cutting insert with a region formed of a superhard material in plan view (FIG. 3A) and cross-sectional view (FIG. 3B).
Figure 3B:
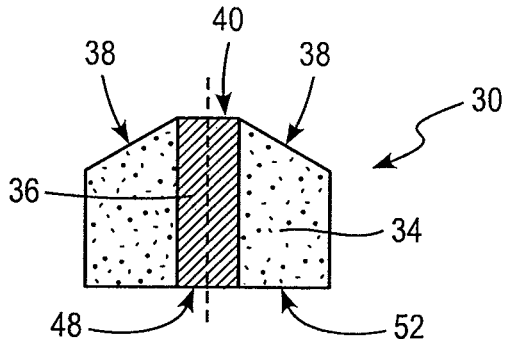

FIGS. 3A and 3B illustrate an exemplary embodiment of a cutting surface 38 with a region formed of a superhard material in plan view (FIG. 3A) and cross-sectional view (FIG. 3B). The plan view in FIG. 3A illustrates the cutting surface 38 of the cutting insert 30. The cross-sectional view in FIG. 3B corresponds to Section B-B in FIG. 3A.

In exemplary embodiments of the cutting insert, the element 36 formed of the superhard material extends from the cutting surface 38 to a base surface 52 of the cutting insert 30. The base surface 52 is generally opposing the cutting surface 36 and the first surface 40 generally opposes the second surface 48. At least a portion of the second surface 48 is exposed on the base surface 52.

As used herein, exposed on the cutting surface 38 can include any of the following situations: the first surface 42 of the element 36 formed of superhard material is coterminous with, projecting outward from or recessed inward from the cutting surface 38. Also, as used herein, exposed on the base surface 52 can include any of the following situations: the second surface 48 of the element 36 formed of superhard material is coterminous with, projecting outward from or recessed inward from the base surface 52.

Figure 5A:
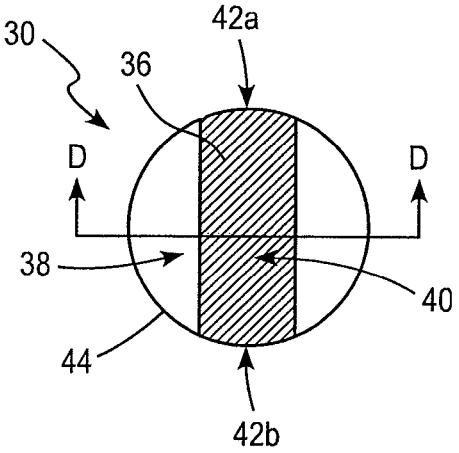
FIGS. 5A and 5B illustrate a further exemplary embodiment of a cutting insert with a region formed of a superhard material in plan view (FIG. 5A) and cross-sectional view (FIG. 5B).
Figure 5B:
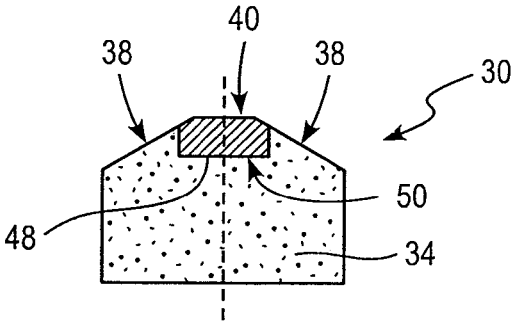

For example and as shown in FIGS. 2B, 3B and 5B, the first surface 42 of the element 36 is coterminous with the cutting surface 38. At the point where the first surface 40 meets the cutting surface 38, the surfaces 38,40 are at the same axial position and there is substantially no step between them. Although the coterminous surfaces can be in the same plane, in other embodiments the surfaces meet at an angle. Even if the surfaces meet at an angle, the respective surfaces 38,40 are continuous across the meeting angle and the first surface 40 of the element 36 is considered coterminous with the cutting surface 38. For example, the cutting surface 38 on the body 34 is tapered from the plane containing the first surface 40 (see, FIGS. 2B and 3B). Also for example, at least a portion of the first surface 40 of the element 36 is correspondingly tapered together with the cutting surface 38 of the body 34 (see, FIG. 5B).

Figure 5C:
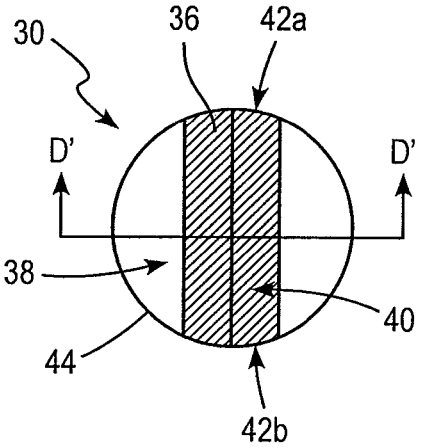
FIGS. 5C and 5D illustrate a further exemplary embodiment of a cutting insert with a region formed of a superhard material in plan view (FIG. 5C) and cross-sectional view (FIG. 5D).
Figure 5D:
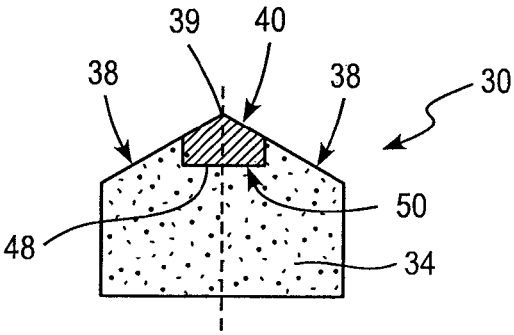

In another embodiment shown in FIGS. 5C and 5D, the cutting surfaces 38 meet at an apex 39. Here, the first surface 40 of the element 36 formed of the superhard material has an edge, without or, alternatively, with a minimized planar surface as compared to the first surface 40 in, for example, FIGS. 5A and 5B. Such an apex can be squared or have a radius and can be used in various disclosed embodiments. The cross-sectional view in FIG. 5B corresponds to Section D'-D' in FIG. 5A.

Figure 4A:
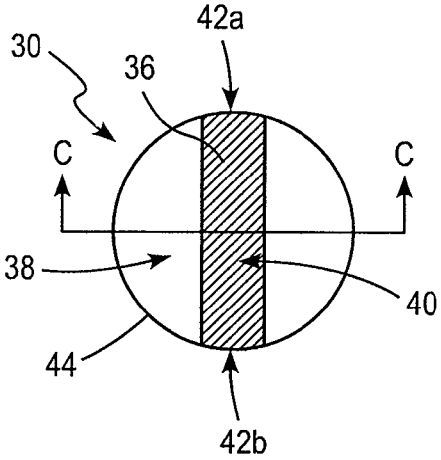
FIGS. 4A and 4B illustrate another exemplary embodiment of a cutting insert with a region formed of a superhard material in plan view (FIG. 4A) and cross-sectional view (FIG. 4B).
Figure 4B:
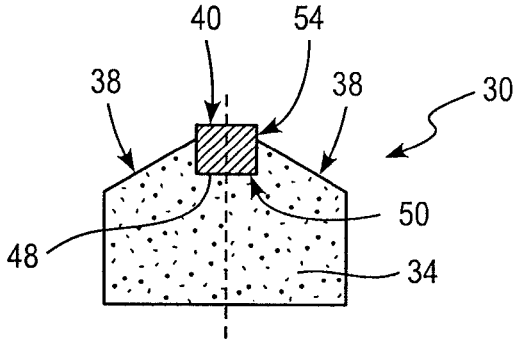

In another example, and as shown in FIG. 4B, the first surface 40 of the element 36 projects outward from the cutting surface 38. There is a step 54 between the first surface 40 and the cutting surface 38.

The cutting insert can include a plurality of elements formed of superhard material. FIGS. 6A-C, 7A-C, 9A-C and 10 illustrate examples of cutting inserts 30 including a plurality of elements 36 formed of superhard material. The plurality of elements can be positioned in various orientations. For example, a plurality of elements 36 can be exposed on the cutting surface 38 of the cutting insert 30 in a row or column relationship (see, e.g., FIGS. 6A-C and 7A-C) or in a grid relationship (see, e.g., FIG. 10A) or quadrant relationship (see, e.g., FIG. 10B). Alternatively, a plurality of elements 36 can be embedded within the body 34 of the cutting insert 30, with none or one or more of the embedded cutting elements 36 having one or more end surfaces 42*a*, 42*b* exposed at a peripheral surface of the cutting insert 30 (see, e.g., FIGS. 9A-C).

The shape of the element 36 formed of superhard material can be considered to have a first surface 40, a second surface 48 opposing the first surface 40, and sides surfaces, including end surfaces 42*a*, 42*b*, connecting the first surface 40 and the second surface 48 to form a generally prismatic shape or a generally polygonal shape with three axes. The shape of the element 36 has a first axis on which lay the opposing first surface 40 and the second surface 48. This first axis is typically orthogonal to the planes containing the first surface 40 and the second surface 48 (see, e.g., FIGS. 6B and D), but can be angled in some instances (see, e.g., FIGS. 6C and 7C). The shape of the element 36 has a second axis on which lay the opposing end surfaces 42*a*, 42*b*. This second axis is typically orthogonal to the planes containing the end surfaces 42*a*, 42*b*. The shape of the element 36 has a third axis on which lay the opposing side surfaces. This third axis is typically orthogonal to the planes containing the side surfaces.

The various axes of the elements 36 can be oriented in various ways to promote improved wear of the cutting insert 30. For example, an element 36 or one or more of the plurality of elements 36 can be oriented with a first axis (i) perpendicular to the base surface 52 of the cutting insert 30 (see, e.g., FIGS. 3B, 6D, 7D and 8B) or (ii) at a non-right angle to the base surface 52 of the cutting insert 30 (see, e.g., FIGS. 6C and 7C) and can intersect (i) the base surface 52 (see, e.g., FIGS. 3B, 6C-D, 7C-D and 8B) or (ii) the peripheral surface (see, e.g., FIGS. 6C, 7C and 9C-D), or a combination of any of these features can be used (see, e.g., FIGS. 6C and 7C).

In a similar fashion, an axis between two opposing side surfaces can be oriented in various ways to promote improved wear of the cutting insert 30. For example, an element 36 or one or more of the plurality of elements 36 can be oriented with a third axis, i.e., the axis on which lie opposing side surfaces, can be oriented to intersect a peripheral surface of the cutting insert (see, e.g., FIGS. 4A, 5A, 6A and C, 7A and C, and 9A and 9C-E).

In some embodiments, at least one side surface is exposed on the peripheral surface of the cutting insert. This side surface can be an end surface 42*a*, 42*b* or a different side surface and (i) can be associated with an element 36 on the cutting surface 38 of the cutting insert 30 (see, e.g., FIGS. 4A, 5A and 9A and 9C-E), (ii) can be associated with an element 36 embedded inward from the cutting surface 38 of the cutting insert 30 (see, e.g., FIGS. 9A and 9C-E), (iii) can be associated with a element 36 at an angle to the base surface 52 (see, e.g., FIGS. 6A and C and 7A and C) or parallel to the base surface 52 (see, e.g., FIG. 9C-E), or (iv) can be a combination of any of these features.

Figure 9A:
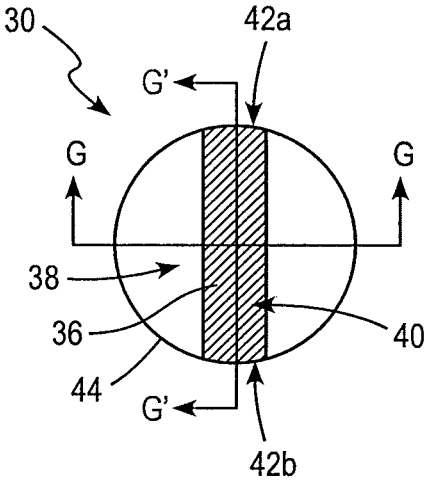
FIGS. 9A-9C illustrate an additional exemplary embodiment of a cutting surface with a region formed of a superhard material in plan view (FIG. 9A) and two different cross-sectional views (FIGS. 9B and 9C).
Figure 9B:
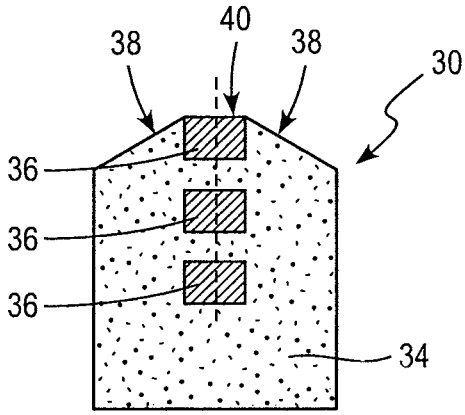
Figure 9C:
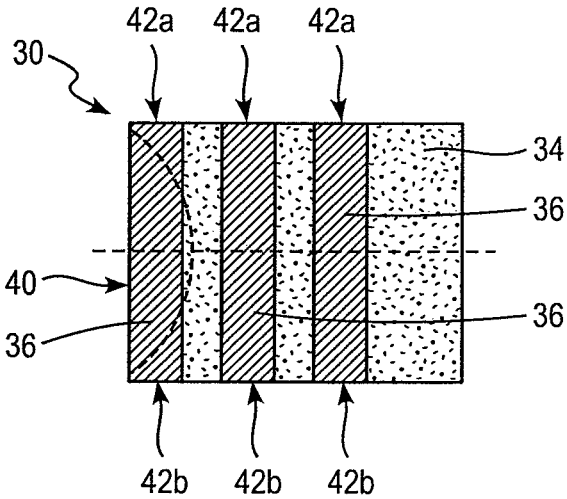
Figure 9D:
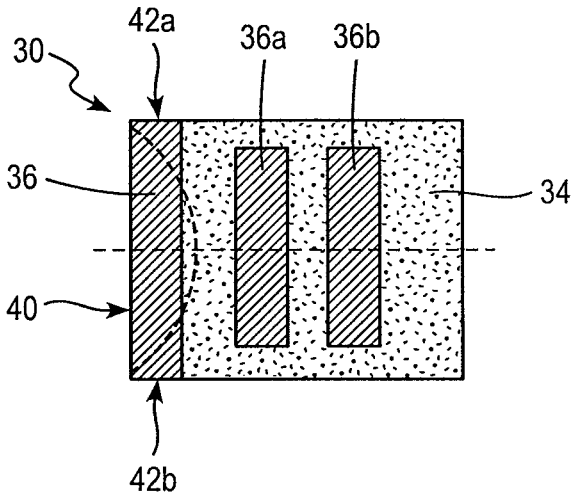
FIGS. 9D-E illustrate in cross-sectional view alternative embodiments of the cutting insert of FIGS. 7A-C with a different orientation of the elements formed of superhard material. An example of elements terminating in the interior of the body of the cutting insert is illustrated.
Figure 9E:
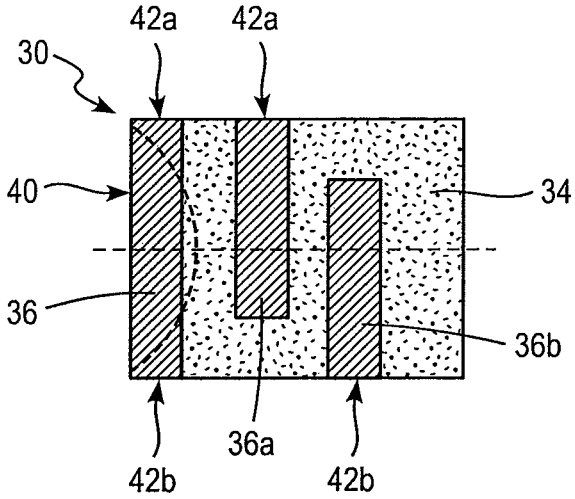
Figure 11A:
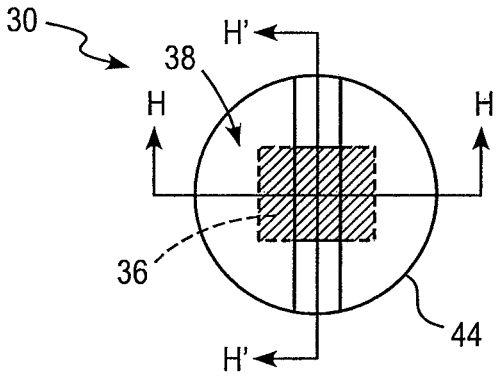
FIGS. 11A-C illustrate an additional exemplary embodiment of a cutting surface with a region formed of a superhard material in plan view (FIG. 11A) and two different cross-sectional views (FIGS. 11B and 11C).
Figure 11B:
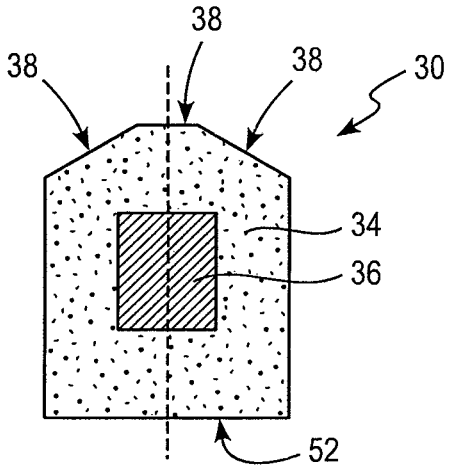
Figure 11C:
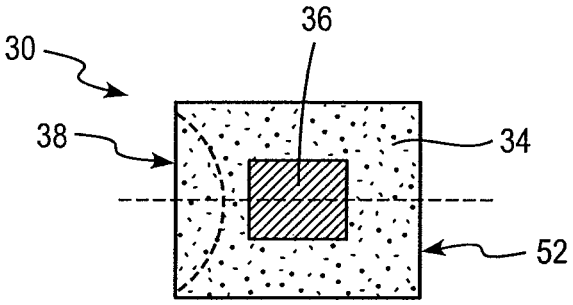

In another example, the cutting insert 30 includes a second element 36 formed of the superhard material that is completely interior to the body 34 of the cutting insert 30. For example, FIG. 9D illustrates an alternative exemplary embodiment of the cutting insert 30 illustrated in FIGS. 9A-C, but with a second element 36*a* and third element 36*b* interior to the body 34 of the cutting insert 30. Although shown in FIG. 9D as completely interior to the body 34 of the cutting insert 30, the second element 36*a* and/or the third element 36*b* can alternatively includes at least one side surface exposed on the peripheral surface of the cutting insert (see, e.g., FIG. 9E). Also for example, FIGS. 11A-C illustrate illustrates an alternative exemplary embodiment of the cutting insert 30 with an element 36 formed of superhard material interior to the body 34 of the cutting insert 30. In this FIGS. 11A-C embodiment, there is no exposed element 36 when the cutting insert 30 is formed, but as the body 34 wears away in use, the element 36 can become exposed.

Cutting inserts 30 with a plurality of elements 36 formed of superhard material can be described as having the element(s) 36 positioned as a vein in the body 34 of the cutting insert 30. In this orientation, the cutting insert 30 can include a first surface exposed on the cutting surface 38 of the cutting insert 30 to form a plurality of discreet areas of exposed superhard material.

Figure 6A:
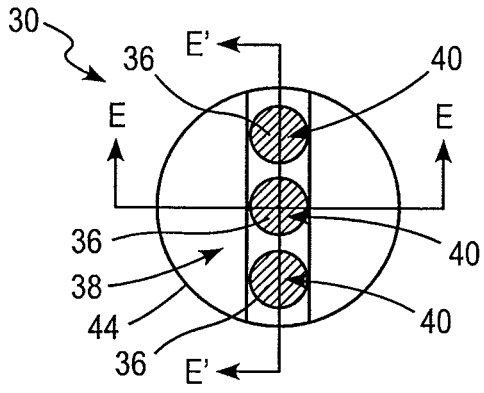
FIGS. 6A-6C illustrate an additional exemplary embodiment of a cutting insert with a region formed of a superhard material in plan view (FIG. 6A) and two different cross-sectional views (FIGS. 6B and 6C).
Figure 6B:
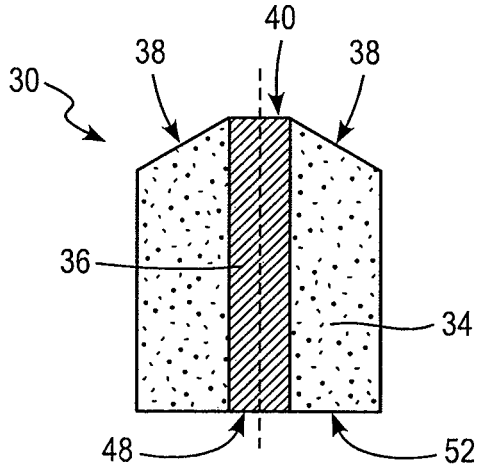
Figure 6C:
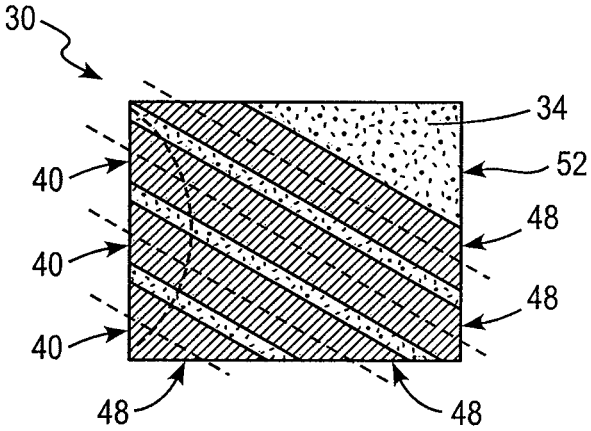
Figure 6D:
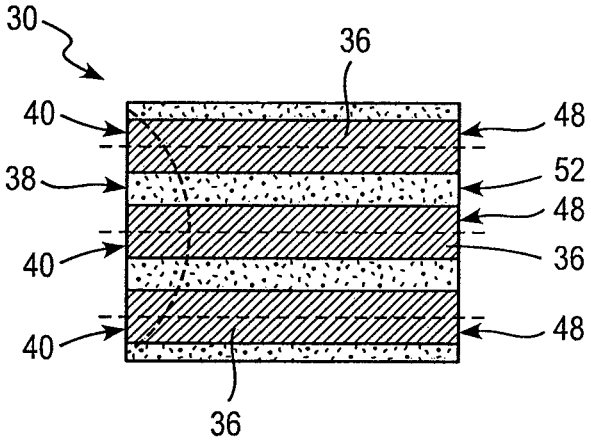
FIG. 6D illustrates in cross-sectional view an alternative embodiment of the cutting insert of FIGS. 6A-C with a different orientation of the elements formed of superhard material.
Figure 7A:
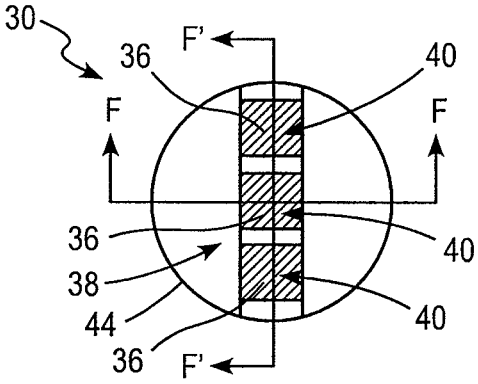
FIGS. 7A-7C illustrate an additional exemplary embodiment of a cutting insert with a region formed of a superhard material in plan view (FIG. 7A) and two different cross-sectional views (FIGS. 7B and 7C).
Figure 7B:
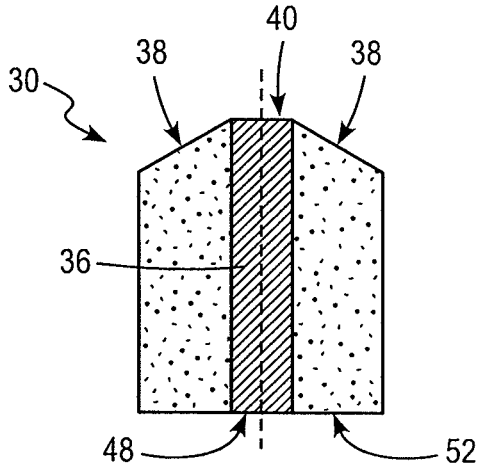
Figure 7C:
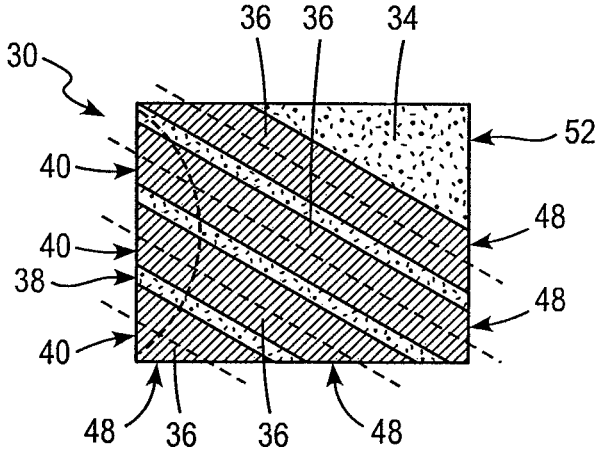
Figure 7D:
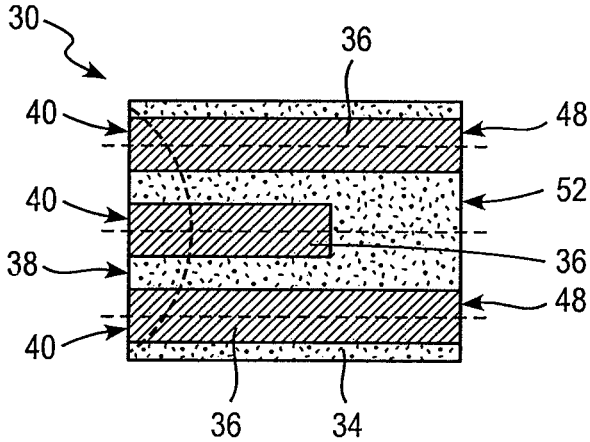
FIG. 7D illustrates in cross-sectional view an alternative embodiment of the cutting insert of FIGS. 7A-C with a different orientation of the elements formed of superhard material. An example of elements terminating in the interior of the body of the cutting insert is illustrated.

FIGS. 6A and 7A illustrate an example of elements 36 formed of superhard material positioned as veins in the body 34 of the cutting insert 30 and having a first surface exposed on the cutting surface 38 to form a plurality of discreet areas. In FIG. 6A, the exposed first surface are generally circular and, in FIG. 7A, the exposed first surface are generally quadrilateral, but any alternative shape can be used that provides a suitable exposed area on the cutting surface 38.

Figure 10A:
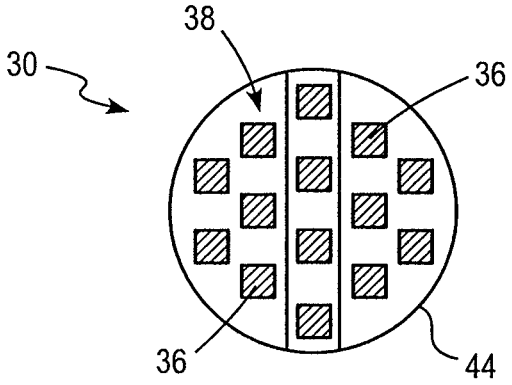
FIGS. 10A and 10B each illustrate an exemplary embodiment of a cutting surface with a region formed of a superhard material in plan view with an arrangement of exposed cutting elements arranged in a grid pattern on the cutting surface (FIG. 10A) and arranged in a quadrant pattern on the cutting surface (FIG. 10B).
Figure 10B:
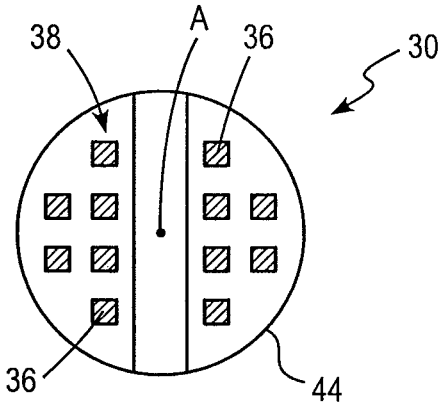

FIGS. 10A-B illustrate an additional example of elements 36 formed of superhard material positioned as veins in the body 34 of the cutting insert 30 and having a first surface exposed on the cutting surface 38 to form a plurality of discreet areas. In FIG. 10A, the exposed first surface of the plurality of elements 36 are arranged in a grid, which can be aligned in rows and columns or staggered as shown; in FIG. 10B, the exposed first surface of the plurality of elements 36 are arranged in quadrants relative to an axis A of the cutting insert 30.

In general and as disclosed herein, the area of the element 36 formed of superhard material exposed on the cutting surface 38 occupies less than the entire area of the cutting surface 38. Where a plurality of elements 36 are exposed on the cutting surface 38, such as is shown in FIGS. 6A, 7A and 10A-B, then the total surface area of the exposed elements 36 occupy less than the entire area of the cutting surface 38. Further, during use the cutting surface 38 is eroded away changing the working area, i.e., the area of the cutting surface 38 that contacts the mineral formation when in use, but during this period, the area of the exposed superhard material remains less than the area of the cutting surface. This process can provide a self-sharpening of the pick and/or a sharper pick.

Figure 8A:
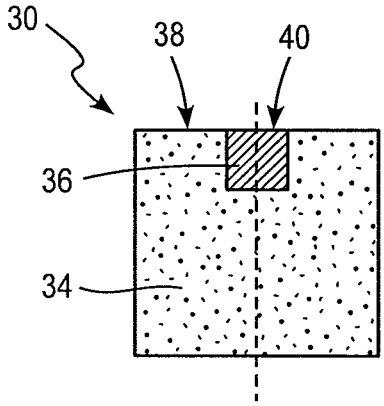
FIGS. 8A and 8B illustrate additional exemplary embodiments of a cutting insert having a prismatic shape with a region formed of a superhard material in plan cross-sectional views.
Figure 8B:
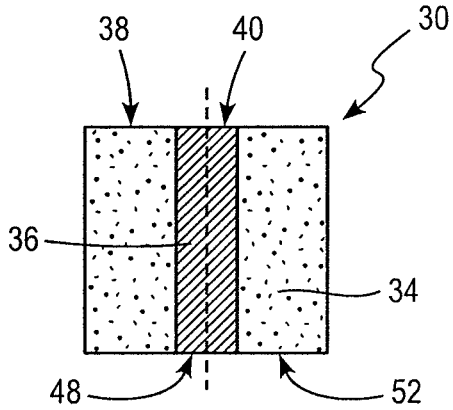

Any of the embodiments of the cutting insert 30 can be embodied in any prismatic shape, with one or more of the side surface or the cutting surface have the shape of, for example, a square, a rectangle, or other N-agon, where N represents the number of sides (five, six, seven, etc. . . . ). As an example, FIGS. 8A and 8B illustrate additional exemplary embodiments of a cutting insert having a prismatic shape with a region formed of a superhard material in plan cross-sectional views. In FIG. 8A, the element 36 of superhard material is mounted in a cutting surface 38 and extends inward, but not to, the base surface 52; In FIG. 8B, the element 36 of superhard material is mounted in a cutting surface 38 and extends inward to the base surface 52. The cutting surface 38 of the cutting insert 30 in each of FIGS. 8A-B has the shape of a square. The square shape of one or more of the cutting surface 38 and the cross-section of the body 34 can be substituted for the generally right cylinder shape of the cutting insert 30 shown in various plan and cross-section views in FIGS. 2-7 and 9-11. Furthermore, the cutting insert 30 in FIGS. 8A-B can be provided with tapered edges by, for example, mechanical means such as grinding. The taper of the tapered edges can be limited to the body 34 (see, e.g., FIGS. 2B, 3B and 4B) or can include the element 36 formed of superhard material (see, e.g., FIG. 5B).

Superhard materials as used herein include any material having a knoop hardness greater than or equal to 2800. The knoop hardness of some select materials, including some superhard materials, is presented below:

| Material | Knoop Hardness |
|---|---|
| Diamond | 6500-7000 |
| Polycrystalline Diamond (PCD) | 4000-7000 |
| Cubic boron nitride (CBN) | 4700 |
| Boron carbide ($B_4C$) | 2800 |
| Silicon carbide (SiC) | 2480-2500 |
| Aluminum oxide ($Al_2O_3$) | 2000-2100 |

Exemplary embodiments of the superhard material used herein include CBN and PCD. Other materials that can be used for the superhard material include (i) PCD with greater than about 80% diamond with diamond-to-diamond bonding, (ii) PCD (greater than about 30% diamond) with added phases of one or more of refractory metals, transition metals, carbides and nitrides, (iii) high diamond content composites such as Ringwood (compacts using silicon carbide (SiC) and related materials to form strong inter-particle bonds among diamond grains at intermediate high pressures), WC with diamond additions and optional also one or more of carbides and nitrides, mixtures of superhard material, (iv) single crystal or CVD polycrystalline diamond, and (v) any one of (i) to (iv) with some or all of the diamond substituted by CBN.

Exemplary embodiments of the mining cutter pick are manufactured by a method comprising fusing the element formed of the superhard material to the body of the cutting insert in a high pressure/high temperature (HPHT) process. An example HPHT process is disclosed in U.S. Pat. Nos. 3,141,746; 3,745,623; 3,609,818; 3,850,591; 4,394,170; 4,403,015; 4,797,326 and 4,954,139, the entire contents of each are incorporated herein by reference. A method for lower diamond content PCE is disclosed in U.S. Pat. No. 4,124,401, the entire contents of which are incorporated herein by reference. In specific examples, the method of manufacturing utilizes an initial sintered body or green body that is then formed into the cutting insert by a HPHT process.

For example, a method of manufacturing a cutting insert for a radial tool pick comprises forming a void space in a sintered body formed of a composition including tungsten carbide and placing a composition including powdered superhard material in the void space. The composition including powdered superhard material is then fused to the sintered body by a HPHT process to form the cutting insert. Optionally, the formed cutting insert can by ground on the cutting surface to taper an edge of a cutting surface and/or the superhard material.

Also for example, a method of manufacturing a cutting insert for a radial tool pick comprises forming a void space in a green body formed of a composition including tungsten carbide and placing a composition including powdered superhard material in the void space. The green body is then sintered while simultaneously fusing the composition including powdered superhard material to the sintered body by a HPHT process to form the cutting insert. Subsequently, the formed cutting insert can optionally by ground on the cutting surface to taper an edge of a cutting surface.

The void space can be any suitable void space. For example, the void space can be one of a hole from a first side to a second side of the body, a recess terminating with a base in an interior of the body, a plurality of holes, a plurality of recesses, or a combination thereof. In exemplary embodiments, the void space is formed by electrical discharge machining (EDM) or in a molding operation.

In exemplary embodiments, the composition including powdered superhard material can include one or more of cobalt or other known diamond solvents and an adjustment material added in powder form. Examples of adjustment materials include refractory metals, transition metals, carbides and nitrides. Also, the composition of the body can include cobalt or other known diamond solvents and at least a portion of the cobalt or solvent for the composition migrates into the powdered superhard material during the HPHT process.

Figure 12:
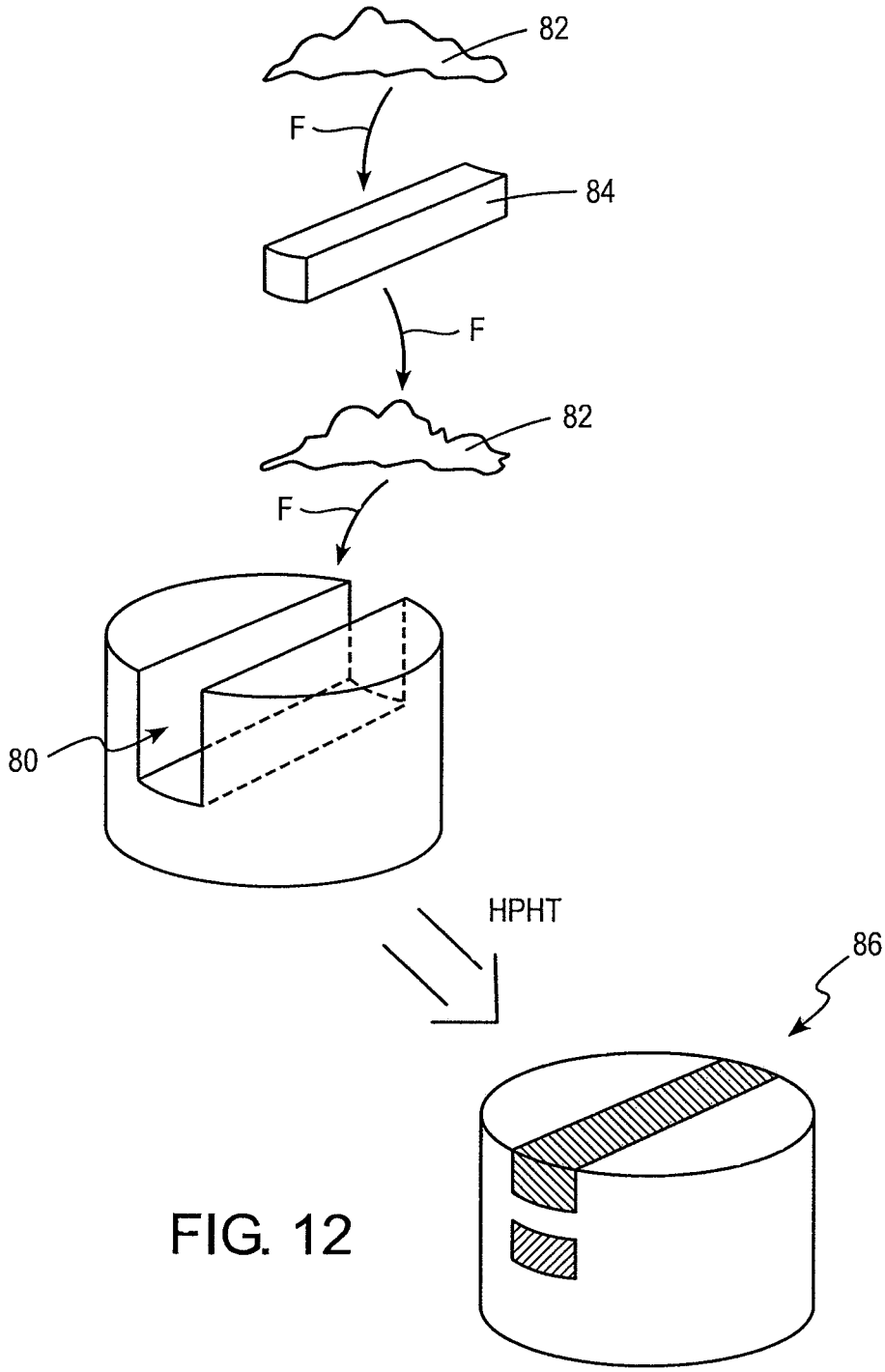
FIG. 12 illustrates a portion of the method to manufacture an embodiment of the cutting insert of a disclosed mining cutter pick in which the composition including powdered superhard material is placed in a void space in a layered arrangement.

Placing the composition including powdered superhard material in the void space is generally accomplished by filling the void spaced with a premixed powdered composition, with or without a compaction step. Where the finished cutting insert is to have a plurality of elements formed from superhard material, multiple void spaces may be employed that are then each filled with the composition including powdered superhard material. Alternatively, and as shown in expanded view in FIG. 12, a void space 80 can be prepared and filled (F) by alternating volumes of the composition 82 including powdered superhard material and a spacer 84, for example a spacer including tungsten carbide or other composition to match the composition of the body of the cutting insert. This alternative approach produces a layered arrangement of the composition including powdered superhard material and the spacer, which is subsequently fused in the HPHT process to produce the cutting insert 86.

Figure 13:
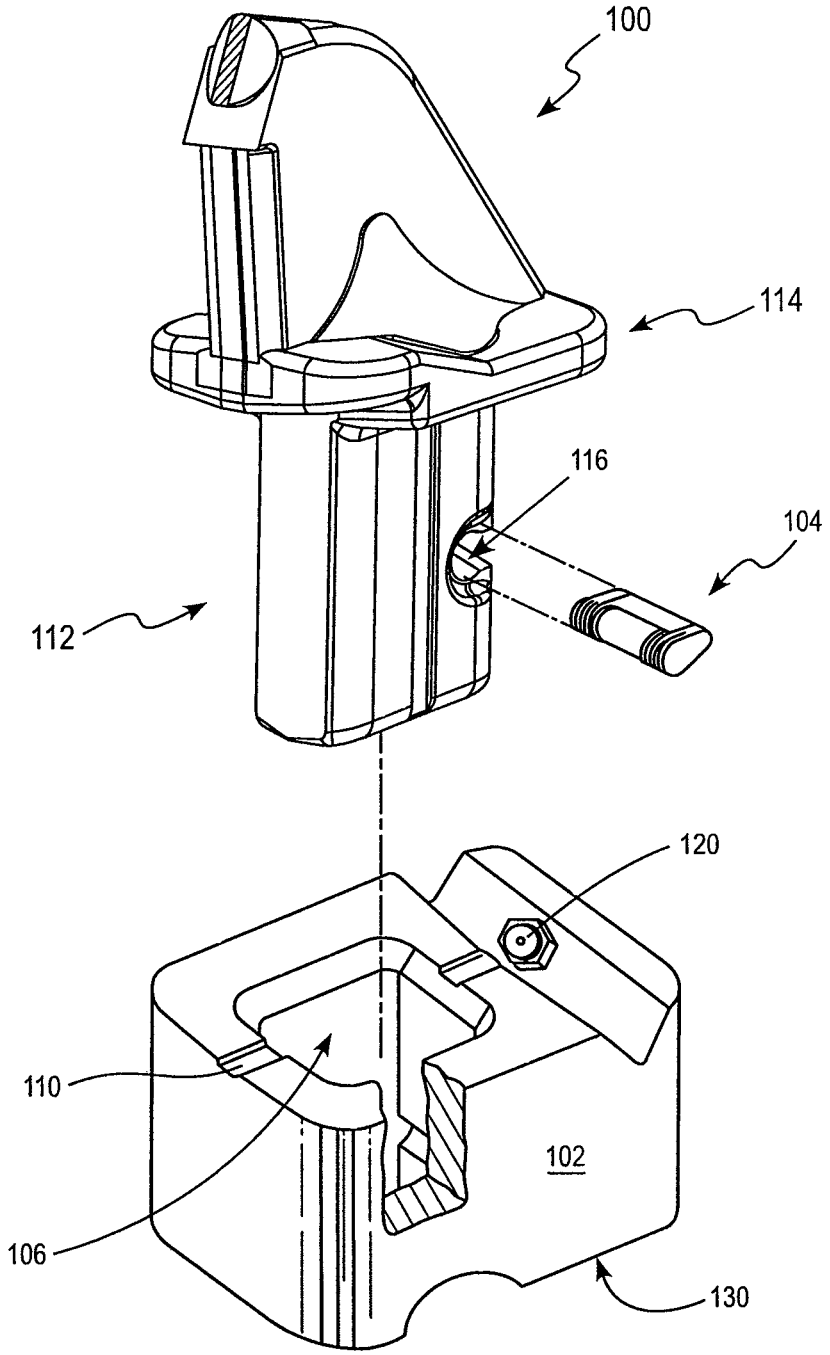
FIG. 13 illustrates in disassembled view an exemplary embodiment of a mining cutter pick, a pick box and a retaining device.

The assembled tool pick and sleeve can subsequently be mounted in a socket of a pick box to form an assembly. FIG. 13 illustrates in disassembled view an exemplary embodiment of a mining cutter pick 100, a pick box 102 and a retaining device 104. The pick box 102 has a socket 106 opening onto an outer wall comprising laterally opposite surfaces arranged to substantially mate with the complementary surface of the shoulder 114 of the cutter pick 100. An optional groove 110 can be included to provide clearance for any forging flash on the pick, so that the opposed surfaces of the shoulder and the pick box can fit together closely. An offset portion at the front of the shoulder can optionally be provided to leave a positive clearance between the pick and the box into which an extraction tool can be inserted to assist removal of the pick from the box. Also optionally present, each corner and the pick box has a general shape with radii to complement radii on the shank. This results in a stronger box than that generally provided by designs having sharp corners.

The pick shank 112 is illustrated with an opening 116, such as a slot, for a retaining device 104 to retain the pick 100 in the box 102. Preferably the retaining device is of a form that draws the opposed inclined faces together so as to hold them in substantially face-to-face contact. In this way the passage of foreign matter between them is minimized. The pick box is also shown with a connection 120 for a water spray to suppress dust during cutting operations.

An exemplary pick box is described and illustrated in U.S. Pat. No. 4,913,125, the entire contents of which are incorporated herein by reference.

A base portion 130 of the pick box 102 is adapted for mounting to a rotating element of a cutting machine such as a mining machine, construction machine, tunneling machining or trenching machine. An exemplary cutting machine comprises a rotating element in the form of a rotatable drum, and one or more pick boxes mounted on the rotatable drum, for example, by bolts and/or welds. Exemplary embodiments of cutter picks as described and disclosed herein can be mounted in a socket of the pick box mounted on the rotatable element. Sandvik model MT720 tunneling machine or Voest-Alpine's Alpine Bolter Miner ABM 25 are examples of such cutting machines.

Although described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A non-rotating mining cutter pick, comprising:

a shank portion with a non-circular cross-section;

a head portion including a front portion and a tip region distal from the shank portion and including opposing flank surfaces connecting a front surface to a rear surface; and a cutting insert mounted at a front end of the tip region with a cutting surface oriented on a same side of the head portion as the front portion, wherein the cutting insert includes a body formed of tungsten carbide and an element formed of a superhard material, wherein the element formed of the superhard material extends into the tungsten carbide body and is fused to the tungsten carbide body, wherein the element formed of the superhard material includes a first surface and an opposing second surface, wherein at least a portion of the first surface of the element formed of the superhard material is exposed on the cutting surface of the cutting insert and, at a periphery, is flush with adjacent portions of the cutting surface of the cutting insert, wherein at least a portion of the front surface of the head portion is formed of a superhard material, and wherein the at least a portion of the front surface of the head portion formed of the superhard material is discontinuous from the element formed of the superhard material that is exposed on the cutting surface of the cutting insert such that a portion of the tip region is exposed and separates the discontinuous superhard materials.

2. The non-rotating mining cutter pick of claim 1, wherein the element formed of the superhard material extends through the body from the cutting surface to a base surface of the cutting insert, the base surface opposing the cutting surface, wherein at least a portion of the second surface of the element formed of the superhard material is exposed on the base surface.

3. The non-rotating mining cutter pick of claim 1, wherein the second surface extends to an interior surface of the body.

4. The non-rotating mining cutter pick according to claim 2 or 3, wherein an orientation of an axis between the first surface and the second surface is perpendicular to the base surface.

5. The non-rotating mining cutter pick according to claim 2 or 3, wherein an orientation of an axis between the first surface and the second surface is at a non-right angle to the base surface.

6. The non-rotating mining cutter pick of claim 1, wherein an axis between the first surface and the second surface intersects a peripheral surface of the cutting insert.

7. The non-rotating mining cutter pick of claim 1, wherein the cutting insert includes a plurality of elements formed of the superhard material.

8. The non-rotating mining cutter pick of claim 7, wherein each of the plurality of elements formed of the superhard material is positioned as a vein in the body of the cutting insert with its first surface exposed on the cutting surface of the cutting insert to form a plurality of discreet areas of exposed superhard material.

9. The non-rotating mining cutter pick of claim 1, wherein the element formed of the superhard material includes the first surface, the opposing second surface and connecting side surfaces, and wherein an orientation of an axis between two opposing connecting side surfaces intersects a peripheral surface of the cutting insert.

10. The non-rotating mining cutter pick of claim 9, wherein at least one side surface is exposed on the peripheral surface of the cutting insert.

11. The non-rotating mining cutter pick according to claims 9 and 10, wherein the cutting insert includes a second element formed of the superhard material, wherein the second element is completely interior to the body of the cutting insert.

12. The non-rotating mining cutter pick according to claims 9 and 10, wherein the cutting insert includes a second element formed of the superhard material, wherein the second element includes at least one side surface exposed on the peripheral surface of the cutting insert.

13. The non-rotating mining cutter pick of claim 1, wherein an area of superhard material exposed on the cutting surface is less than a full working area of the cutting insert.

14. The non-rotating mining cutter pick of claim 1, wherein the superhard material is any material with a knoop hardness greater than or equal to 2800.

15. The non-rotating mining cutter pick of claim 1, wherein the exposed surface of the at least a portion of the first surface of the element formed of the superhard material does not extend outward beyond an extension of the adjacent one or more planes of the cutting surface.

16. A cutting machine, comprising:

a rotatable element; and the non-rotating mining cutter pick of claim 1 mounted in a socket of a pick box mounted on the rotatable element.

17. A method of manufacturing the non-rotating mining cutter pick of claim 1, the method comprising fusing the element formed of the superhard material to the tungsten carbide of the cutting insert in a high pressure / high temperature (HPHT) process.

* * * * *